US009057254B2

(12) United States Patent
Hull

(10) Patent No.: US 9,057,254 B2
(45) Date of Patent: Jun. 16, 2015

(54) METHOD FOR DETECTING AND LOCATING FLUID INGRESS IN A WELLBORE

(75) Inventor: John Hull, Calgary (CA)

(73) Assignee: Hifi Engineering Inc., Calgary, Alberta (CA)

( * ) Notice: Subject to any disclaimer, the term of this patent is extended or adjusted under 35 U.S.C. 154(b) by 423 days.

(21) Appl. No.: 13/017,620

(22) Filed: Jan. 31, 2011

(65) Prior Publication Data

US 2011/0188346 A1 Aug. 4, 2011

(30) Foreign Application Priority Data

Feb. 1, 2010 (CA) ..... 2691462

(51) Int. Cl.
*E21B 47/10* (2012.01)

(52) U.S. Cl.
CPC ..... *E21B 47/101* (2013.01)

(58) Field of Classification Search
CPC ..... E21B 47/101
USPC ..... 367/35; 702/6, 8; 181/105
See application file for complete search history.

(56) References Cited

U.S. PATENT DOCUMENTS

| | | | | |
|---|---|---|---|---|
| 4,114,721 | A * | 9/1978 | Glenn, Jr. | 181/105 |
| 4,646,273 | A * | 2/1987 | Carlson et al. | 367/32 |
| 4,744,416 | A * | 5/1988 | Bower | 166/253.1 |
| 5,124,952 | A * | 6/1992 | Knize et al. | 367/34 |
| 5,275,040 | A | 1/1994 | Codazzi | |
| 2004/0169505 | A1 | 9/2004 | Alun et al. | |
| 2005/0063251 | A1 * | 3/2005 | Guidry et al. | 367/35 |
| 2006/0133203 | A1 * | 6/2006 | James et al. | 367/27 |
| 2008/0105427 | A1 | 5/2008 | Hampton et al. | |
| 2009/0059720 | A1 * | 3/2009 | Heigl | 367/35 |
| 2009/0114386 | A1 * | 5/2009 | Hartog et al. | 166/250.08 |
| 2009/0326826 | A1 | 12/2009 | Hull et al. | |

FOREIGN PATENT DOCUMENTS

WO WO2008/098380 A1 8/2008

OTHER PUBLICATIONS

Office Action from Canadian Intellectual Property Office, for corresponding Canadian Patent Application No. 2,691,462, dated Sep. 12, 2012, 3 pages.

International Search Report for International Application No. PCT/CA2011/000031, dated Apr. 6, 2011.

* cited by examiner

*Primary Examiner* — Isam Alsomiri
*Assistant Examiner* — Hovhannes Baghdasaryan
(74) *Attorney, Agent, or Firm* — Klarquist Sparkman, LLP

(57) ABSTRACT

A method for detecting fluid ingress in a wellbore. An acoustic sensor is placed along a wellbore. The acoustic sensor is adapted to sense individual acoustic signals from a plurality of corresponding locations along the wellbore. The individual acoustic signals are analyzed to determine if there exists a common acoustic component in acoustic signals generated from proximate locations in the wellbore. If so, the acoustic signal having the common acoustic component which appears earliest in phase, by virtue of such acoustic signal's corresponding location in the wellbore, determines the location in the wellbore of likely fluid ingress. The acoustic sensor may be a fiber optic cable extending substantially the length of the wellbore, or alternatively a plurality of microphones situated at various locations along the wellbore.

26 Claims, 13 Drawing Sheets

50 a

500M
'd'
A
50 b
1000M
40
45
'd'
Depth
40
50c
40
B
1500M
WELLBORE
'd'
15
50d
2000M

METHOD FOR DETECTING AND LOCATING FLUID INGRESS IN A WELLBORE

CROSS-REFERENCE TO RELATED APPLICATIONS

Priority is claimed from Canadian patent application 2,691,462 filed Feb. 1, 2010, entitled, "Method For Detecting And Locating Fluid Ingress In A Wellbore," listing John Hull as inventor, such Canadian patent application incorporated herein by reference.

FIELD

The present invention relates to fluid migration in oil or gas wells, and more particularly to a method of detecting ingress of fluid along a wellbore.

BACKGROUND

This section provides background information related to the present disclosure which is not necessarily prior art.

As explained in WO 2008/098380 assigned to a common owner of the within application, ingress of fluids such as gases or liquids into wellbores, where such fluids may (and typically do) then migrate to surface in the area between the wellbore and the casing and thus undesirably escape into the atmosphere, are a serious and increasing environmental concern. Specifically, fluids which seep into wellbores commonly comprise gases and liquids which are toxic, such as for example and including hydrogen sulfide, and/or are greenhouse gases such as methane. This is occurring more frequently in view of the increasing number of hydrocarbon wells being drilled. The path of such fluids to the surface can arise due to fractures around the wellbore, fractures in the production tubing, poor casing to cement/cement-to-formation bond, channeling in the cement, or various other reasons.

The ingress of fluid into a wellbore and subsequent fluid migration to surface is known as casing vent flow ("CVF") or gas migration ("GM") and may occur at any time in the life of the well, and even when the well has been sealed when no longer sufficiently productive.

Wellbores found to have aberrant or undesired fluid ingress (generally, gas or liquid hydrocarbon) and migration (i.e., a 'leak') must be repaired to stop such ingress. This may entail halting a producing well, or making the repairs on an abandoned or suspended well. The repair of these situations does not generate revenue for the gas/oil company, and can cost millions of dollars per well to fix the problem.

In order to deal with the leak and thus prevent the ingress of fluids into a wellbore, a basic strategy in the prior art included: identifying the location in the wellbore where there is ingress of liquids such as gas; communicate with the leaking fluid source (i.e. make holes in production casing and/or cement in order to effectively access the formation), and; plug, cover or otherwise stop the leak (i.e. inject or apply cement above and into the culprit formation in order to seal or 'plug' the gas source, preventing future leaks).

Materials and methods for stopping leaks associated with oil or gas wells are known, and usually involve injection of a liquid or semi-liquid matrix that sets into a gas-impermeable layer. For example, U.S. patent 55/003,227 to Saponja et al describes methods of terminating undesirable gas or liquid hydrocarbon migration in wells. U.S. Pat. No. 5,327,969 to Sabins et al describes methods of preventing gas or liquid hydrocarbon migration during the primary well cementing stage.

Before the leak can be stopped, however, it must first be identified and its location in the wellbore determined.

It is known, and existing systems for leak detection rely on the fact, that ingress of fluids into a wellbore typically generates a noise (acoustic signal), such as a "hiss" from high pressurized gas seeping into the wellbore, or from fluid intermittently "bubbling" into a wellbore.

For such reason the prior art methods and apparatus, in an attempt to identify a location in a wellbore of fluid ingress, utilized an acoustic sensing device such as a microphone or piezoelectric sensor, for attempting to identify a location of a leak in a wellbore. In this regard, the prior art apparatus and methods typically comprise an acoustic sensing device such as a microphone, typically lowered into a wellbore at the end of a cable or wire, and suspended at a depth of interest. Acoustic activity at that depth is recorded for a short period of time. The device is then raised up a further short distance (repositioned) and the process repeated. The recording interval may range from about 10 seconds to about 1 minute, and the repositioning distance from about 2 meters to about 5 meters. Longer recording intervals and shorter repositioning distances may give more accurate data, but at the expense of time.

In the prior art, once acoustic data as described above has been acquired for the complete length of the wellbore, the amplitudes of the acoustic signals obtained (which would include noise of a leak "noise") are typically processed to determine their respective strength or power, the theory being that the strongest or most powerful acoustic signal will likely obtained at the location in the well which is experiencing acoustic noise due to the ingress of fluid at that location into the wellbore. These prior art techniques only work well for high rate leaks (i.e., where the ingress of fluid into the wellbore is high and generating significant and high power acoustic signal from a pinpoint location in the well bore), and where there is relatively low background noise or little interference from other noise sources such as surface noise, and reverberation and resulting sound amplification at other locations in the well is not occurring or is not significant. Using comparisons of the power or strength of the various acoustic signals in such manner as done in the prior art is highly unsatisfactory, as reverberations in wellbores frequently produces higher noise levels at locations within the wellbore considerable remote from the location in the wellbore which is the actual source of the acoustic event, and are thus unsatisfactory for attempting to precisely locate the location of fluid ingress in a wellbore.

As well, where fluid ingress into the wellbore is not under high pressure (but may be still significant in terms of amount) and thus the corresponding acoustic signal is substantially reduced in magnitude and/or is of a sporadic nature such as when gases or liquids bubble periodically into the wellbore, the ability to identify which acoustic signal (and thus the location in the wellbore) that is experiencing fluid ingress is considerably more difficult under the aforementioned prior art methods, and is very unreliable. Again, factors such as reverberation and echoes (as nearly always occur with acoustic signals in wellbores) and/or interfering surface noise each have the undesirable consequence of often making acoustic signals remote from the location of the acoustic event stronger and possessing more power than the acoustic signal emanating from a location in the wellbore most proximate the acoustic event.

Accordingly, the prior art methods of acoustic signal analysis, using signal strength and power (RMS, weighted mean, etc) as a method for comparing acoustic signals as a method for determining which acoustic signal and associated location in a wellbore is likely closest the source of fluid ingress in a well have failed, for the above reasons, to be consistently reliable in precisely locating the location of fluid ingress, even when many acoustic signals are logged over relatively narrow spaced intervals in a wellbore.

Indeed, there has been at least one instance to the inventor's knowledge where in excess of $1 million (Can.) was incurred in initial attempts to locate a leak in a wellbore, wherein prior art acoustic signal analysis methods incorrectly suggested certain locations in a wellbore were the source of the leak. As a result, various (incorrect) locations in such wellbore were, through laborious effort and expense, injected with cement in an attempt to "seal" the wellbore at such locations from CVM and fluid ingress, but which efforts were not successful due to prior art methods being unable to satisfactorily analyze the acoustic signals to as to be able to accurately identify the location the wellbore fluid ingress was occurring.

In view of the above, a real need exists for an improved method to better detect and locate fluid ingress and egress in a wellbore.

SUMMARY

This section provides a general summary of the disclosure, and is not a comprehensive disclosure of its full scope or all of its features.

All citations disclosed are herein incorporated by reference.

In a first broad embodiment of the invention, the invention comprises a method for determining whether there exists fluid ingress in a wellbore, and if so, obtaining an indication of where along said wellbore said fluid ingress is occurring.

The method makes use of the fact that casing vent flow and in particular "leaks" (i.e., fluid ingress into a wellbore) produce detectable and recordable acoustic signals, which acoustic signals may be analyzed so as to determine where in the wellbore the acoustic signal which profiles the "leak" is being generated.

The invention makes use of the finite time which the speed of sound travels in air (or in steel along production tubing or steel casing of a wellbore), as a means of providing an indication, using at least two acoustic signals recording a common acoustic event, where in the wellbore the acoustic event is being generated. Specifically, this principle is used in the method of the present invention when comparing various acoustic signals to determine at least the direction along the wellbore relative to the acoustic sensing means where the noise of a "leak" is emanating from (where only two acoustic sensors are used), or in situation where more than two acoustic signals are simultaneously obtained along a location in a wellbore spanning the location of the leak, to determine the actual proximate location of the "leak" in the wellbore.

Accordingly, in the first broad aspect of the invention comprising a method for determining whether there exists fluid ingress in a wellbore, and if so, obtaining an indication of where along said wellbore said fluid ingress is occurring, comprising the following steps, namely:

(a) receiving a plurality of acoustic signals generated from acoustic sensing means positioned along at least a portion of a wellbore, each of said acoustic signals generated over an identical selected time interval and each of said acoustic signals having associated therewith a corresponding known location along said wellbore;

(b) analyzing each of said received acoustic signals received over said selected time interval to determine if there exists at least a common acoustic component in said acoustic signals generated from proximate locations in said wellbore and which common acoustic component appears earlier in phase in one of said acoustic signals as opposed to other remaining acoustic signals from said proximate locations;

(c) if so, comparing said acoustic signals which are produced from said proximate locations and which contain said common component and determining which acoustic signal and associated location possesses said common component having the earliest phase; and (d) thereby determining an indication of where along said wellbore said fluid ingress is occurring.

The acoustic sensing means may comprise a plurality of acoustic sensors, such as a plurality of piezoelectric microphones, which may be lowered into a wellbore to simultaneously collect a plurality of acoustic signals. Such plurality of microphones may be two (or more) microphones, located a spaced distance apart, which are first lowered to a specific recorded location in a wellbore and two (or more) separate acoustic signals simultaneously recorded. Subsequent additional acoustic signals may be received and analyzed after subsequently lowering the two (or more) microphones to a different depth/location in the wellbore, by repeating steps a)-e) above, and in particular relocating the microphones to another location of the wellbore, and recording the common acoustic event first identified, and thereby obtaining an indication of where along said wellbore said common acoustic event (and thus fluid ingress) is occurring.

Alternatively, and preferably, the acoustic sensing means used in the method of the present invention comprises a fibre optic cable (wire) which is lowered into a wellbore and which extends substantially the length of the wellbore, and which uses time division multiplexing to sense and receive acoustic signals from a plurality of locations (depths) in the wellbore, as described in published PCT patent application WO 2008/098380 having a common inventor with the within application and assigned to a common owner of the within application.

Once the acoustic data is received from the acoustic microphones (where, for example, piezoelectric microphones are used, or alternatively signals are demodulated off the fibre optic cable where a fibre optic cable is used as the acoustic sensing means (hereinafter referred to as the acoustic signals having been "logged"), such raw logged data may be stored for various post-processing, as described herein, in order to attempt to determine common patterns in the logged acoustic signals.

As further explained herein, it is necessary in order for the method of the present invention to be able to provide an indication of where along said wellbore said fluid ingress is occurring that a plurality of (i.e., two or more) acoustic signals be simultaneously logged over the same particular time interval. Such then permits the at least two received acoustic signals received over the selected time interval to be compared to determine if there exists at least a common acoustic component in said acoustic signals generated from proximate locations in said wellbore and which common acoustic component appears earlier in phase in one of said acoustic signals as opposed to other remaining acoustic signals from said proximate locations. Thus it is preferable that the selected time interval be of sufficient duration to include said common acoustic component in at least two acoustic signals emanating from proximate locations along said wellbore. If in a first iteration no common acoustic component appears in each of the two signals, longer time intervals could be utilized to further search for common components within acoustic signals generated along the wellbore.

In a preferred embodiment which has the advantage of not needing to successively reposition the acoustic sensing means along the wellbore for acquiring/logging additional plurality of acoustic signals along the wellbore, the above method comprises:

(a) placing said acoustic sensing means along substantially an entire length of said wellbore, said acoustic sensing means adapted to sense said individual acoustic signals from each of said plurality of corresponding locations along said substantially entire length of said wellbore, each of said acoustic signals having associated therewith a corresponding known location along said substantial length of said wellbore;

(b) receiving said plurality of acoustic signals from said acoustic sensing means over a selected time interval;

(c) analyzing each of said received acoustic signals received over said selected time interval to determine if there exists at least a common acoustic component contained in acoustic signals generated from proximate locations in said wellbore and which common component appears earlier in phase in one of said acoustic signals and successively later in phase in remaining proximate acoustic signals;

(d) if so, comparing said acoustic signals which are produced from said proximate locations in said wellbore containing such component and determining which acoustic signal and associated location possesses said component having the earliest phase; and (e) thereby determining a location along said wellbore having fluid ingress into said wellbore.

With regard to the above step of analyzing the received acoustic signals received over the selected time interval to determine if there exists at least a common acoustic component (i.e., step (c) above), such step may comprise an analysis selected from the group of known acoustic analysis techniques comprising:

(i) an analysis of such acoustic signal with regard to amplitude of such acoustic signal over said time interval;

(ii) a frequency analysis;

(iii) a power analysis examining power as a function of frequency;

(iv) a fast fourier transform;

(v) a root-mean-square analysis of amplitude over time;

(vi) a means/variance analysis;

(vii) a spectral centroid analysis; or (viii) a filter analysis, such as and including a Kalman filter analysis.

For example, simply conducting an amplitude versus time analysis of acoustic signals received at various locations along the wellbore may not be sufficient to permit easy identification of a common component within such signals, namely a common component having a phase angle which is progressively delayed in acoustic signals obtained from proximate locations in a wellbore. For example, if an acoustic event indicative of a leak was making periodic noise events due to periodic bubbles entering the wellbore, and at for example a particular low frequency, say 1000 Hz, it may be necessary to conduct a bandpass filter at low frequency (e.g. 200 Hz-2000 Hz), with possible amplification of such signal, to be best able to identify a significant and common acoustic event occurring at 1000 Hz. Alternatively, such analysis of the received acoustic signals, in order to search for a common component, may further, or initially, require one or a number of power versus frequency analysis to better determine which frequency(ies) are most powerful and thus which frequency(ies) are being emitted by the fluid ingress, and then conducting an amplitude versus time analysis using such selected frequency(ies), in order to determine whether there exists a common component (which is progressively delayed in each acoustic signal [at the selected frequency(ies)], and thus be able to determine the acoustic signal (and its location in the wellbore) having the earliest phase.

By way of express example, a power versus frequency analysis may determine, for sake of argument, that no noise frequencies of any significance are being generated at frequencies other than, say, 1000 Hz. Accordingly, an analysis of only the 1000 Hz component of the acoustic signal, in amplitude versus time, may then be conducted in order to ascertain whether there exists a significant common acoustic event within proximate acoustic signals, and if so, then be able to determine which acoustic signal possesses the earliest phase angle.

As used herein, the terms "earliest phase angle", "earliest in phase" or "earliest phase" mean the earliest point in time that a common component of at least two logged acoustic signals appears in such logged acoustic signals in a given time interval. Specifically, due to the spaced-apart requirement for the locations of the acoustic sensors along the wellbore, an acoustic event which forms a common component of two logged acoustic signals must necessarily be recorded earliest in the acoustic sensing means located closest the source of the acoustic event, and conversely such common component must necessarily be logged later in each of other acoustic signals as they are farther away from the generation of such acoustic event. Thus such common component will appear earliest in the acoustic signal emanating from a location closest the acoustic event, and is thus said to have the common component having the earliest phase angle and "earliest in phase".

In a further preferred embodiment of the above method of the present invention the locations along the wellbore for which acoustic signals are "logged" are preferably individually spaced apart by a distance no more than the distance determined by the speed of sound in steel or air at the wellbore temperature multiplied by the selected time interval. Such is preferable in order to better ensure that in a selected time interval there will at least be two acoustic signals from proximate locations along the wellbore which both record an acoustic "event" indicative of a leak at a particular location in a wellbore. Thus there will thus (potentially) exist a 'common element" between the at least two acoustic signals which will then provide a means of determining from which acoustic signal the common element has the earliest phase and thus the acoustic signal and the corresponding location along the wellbore which is closest to the acoustic event (common element) and thus the location along the wellbore where there is a leak. This is important particularly where the leak (i.e., acoustic event) may have a periodic component and it is thus necessary to capture in at least two acoustic signals the acoustic event within the time interval selected.

In a refinement of the above method, such method further comprises the step of labeling the common component identified in two or more acoustic signals, and yet a further refinement creating an amplitude versus time representation of selected acoustic signals containing a common element and color coding said component in each of said acoustic signals in order to more easily analyze the signals to determine in which the common element has the earliest phase.

Accordingly, in one further refinement of the above method, such method comprises:

(i) creating a visual representation, in amplitude versus time format, of each acoustic signal logged over said selected time interval; and (ii) color coding each identified particular known component of each acoustic signal with a similar color; and (iii) determining, from said graphic representation of said acoustic signals which particular acoustic signal has said color-coded component with the earliest phase angle thereby determining said location in said wellbore having fluid ingress.

Accordingly, in one preferred embodiment of the method of the present invention, the method comprises:

(a) placing acoustic sensing means along at least a portion of a wellbore, said acoustic sensing means adapted to sense at least three acoustic signals from at least three corresponding separately spaced apart locations along a length of said wellbore, each of said acoustic signals having associated therewith a corresponding known location along said wellbore;

(b) receiving said at least three acoustic signals from said acoustic sensing means over a selected time interval, wherein said at least three spaced locations are individually spaced apart by less than the distance determined by the speed of sound in steel or air at the wellbore temperature multiplied by the selected time interval;

(c) analyzing each of said received acoustic signals received over said selected time interval to determine if there exists at least one common acoustic component contained in acoustic signals generated from proximate locations in said wellbore and which common component is earlier in phase in one of said acoustic signals and successively later in phase in remaining proximate acoustic signals;

(d) if so, displaying a graphic representation depicting each of said acoustic signals in an amplitude versus time representation, with time incrementally increasing from left to right and successively arranged one above the other indicating their respective location in said wellbore;

(e) color coding, in each of said acoustic signals which said one component appears, said at least one component in a color different from a remaining graphic representation of said acoustic signals; and (f) determining the color coded component in each of the graphically represented acoustic signals which is located closest the left of the graphical depictions, thereby determining the acoustic signal in said wellbore having the location most proximate a location of fluid ingress in said wellbore.

The above summary of the invention does not necessarily describe all features of the invention. For a complete reference to the embodiments of the invention, reference is to be had inter alia to the claims following this specification.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

The above and other features of the invention will become more apparent from the following description in which reference is made to the appended drawings wherein.

Corresponding reference numerals indicate corresponding parts throughout the several views of the drawings.

DETAILED DESCRIPTION

Figure 1:
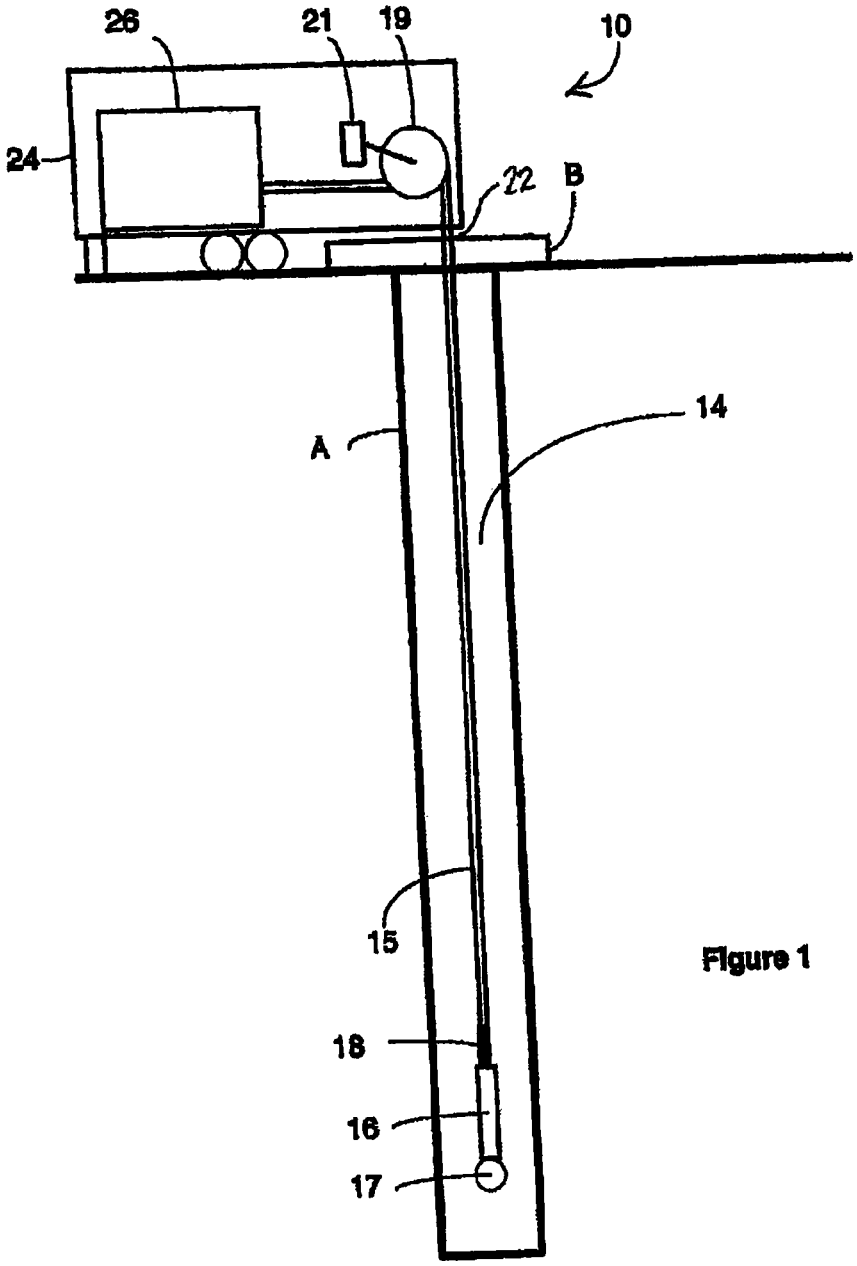
FIG. 1 is a schematic side elevation view of a gas migration detection and analysis apparatus in accordance with an embodiment of the present invention.

Example embodiments will now be described more fully with reference to the accompanying drawings.

In each of the figures hereto, like components are identically referred to by identical reference numerals.

Referring to FIG. 1 and according to one embodiment of the invention, there is provided an apparatus 10 for detecting and analyzing fluid migration in an oil or gas well 14.

Fluid migration in oil or gas wells 14 is generally referred to as "casing vent flow/gas migration" and is understood to mean ingress or egress of a fluid along a vertical depth of an oil or gas well 14, including movement of a fluid behind or external to a production casing of a wellbore A. The fluid includes gas or liquid hydrocarbons, including oil, as well as water, steam, or a combination thereof. A variety of compounds may be found in a leaking well, including methane, pentanes, hexanes, octanes, ethane, sulphides, sulphur dioxide, sulphur, petroleum hydrocarbons (six- to thirty four-carbons or greater), oils or greases, as well as other odor-causing compounds. Some compounds may be soluble in water, to varying degrees, and represent potential contaminants in ground or surface water. Any sort of aberrant or undesired fluid migration is considered a leak and the apparatus 10 is used to detect and analyze such leaks in order to facilitate repair of the leak. Such leaks can occur in producing wells or in abandoned wells, or wells where production has been suspended.

The acoustic signals (as well as changes in temperature) resulting from migration of fluid may be used as an identifier, or 'diagnostic' of a leaking well. As an example, the gas may migrate as a bubble from the source up towards the surface, frequently taking a convoluted path that may progress into and/or out of the production casing, surrounding earth strata and cement casing of the wellbore A, and may exit into the atmosphere through a vent in the well, or through the ground. As the bubble migrates, pressure may change and the bubble may expand or contract, and/or increase or decrease the rate of migration. Bubble movement may produce an acoustic signal of varying frequency and amplitude, with a portion in the range of 20-20,000 Hz. This migration may also result in temperature changes (due to expansion or compression) that are detectable by the apparatus and methods of various embodiments of the invention.

The apparatus 10 shown in FIG. 1 may comprise a flexible fiber optic cable assembly 15 which serves as an acoustic sensing means. Such fiber optic cable assembly may further comprise an acoustic transducer array 16 connected to a distal end of the cable 15 by an optical connector 18, and a weight 17 coupled to the distal end of the transducer array 16. The apparatus 10 also includes a surface data acquisition unit 24 that stores and deploys the cable 15 as well as receives and processes raw acoustic signal data from the cable assembly 15. The data acquisition unit 24 includes a spool 19 for storing the cable assembly 15 in coiled form. A motor 21 is operationally coupled to the spool 19 and can be operated to deploy and retract the cable assembly 15 within wellbore A. The data acquisition unit 24 also includes signal processing equipment 26 that is communicative with the cable assembly 15. The data acquisition unit 24 can be housed on a trailer or other suitable vehicle thereby making the apparatus 10 mobile. Alternatively, the data acquisition unit 24 can be configured for permanent or semi-permanent operation at a wellbore site 14.

The apparatus 10 shown in FIG. 1 is located with the data acquisition unit 24 at surface and above an abandoned wellbore A with the cable assembly 15 deployed into and suspended within the wellbore A. While an abandoned wellbore A is shown, the apparatus can also be used in producing wellbores, during times when oil or gas production is temporarily stopped or suspended. The cable assembly 15 spans a desired depth or region to be logged, which preferably, but not necessarily, is the entire length of the wellbore A. In FIG. 1, the cable assembly 15 spans the entire depth of the wellbore A. The acoustic transducer array 16 is positioned at the deepest point of the region of the wellbore A to be logged. The wellbore A comprises a surface casing, and a production casing (not shown) surrounding a production tubing through which a gas or liquid hydrocarbon flows through when the wellbore A is producing.

FIG. 1 shows fluid ingress 40 in a vertical wellbore A, but fluid ingress 40 in any wellbore such as a vertical and horizontal wellbore combination, or a horizontal wellbore (not shown) may be determined by the method of the present invention.

At surface, a wellhead B closes or caps the abandoned wellbore A. The wellhead B comprises one or more valves and access ports (not shown) as is known in the art. The fiber optic cable assembly 15 extends out of the wellbore 14 through a sealed access port (e.g., a 'packoff') in the wellhead 22 such that a fluid seal is maintained in the wellbore A.

In the preferred embodiment of the invention where the acoustic sensing means comprises a fiber optic cable 15, such cable 15 comprises a plurality of fiber optic strands. The optical fibers thereof act as an acoustic transducer.

Optical fibers, such as those used in some aspects of the invention, are generally made from quartz glass (amorphous $SiO_2$). Optical fibers may be 'doped' with rare earth compound, such as oxides of germanium, praseodymium, erbium, or similar) to alter the refractive index, as is well-known in the art. Single and multi-mode optical fibers are commercially available, for example, from Corning Optical Fibers (New York). Examples of optical fibers available from Corning include ClearCurve™ series fibers (bend-insensitive), SMF28 series fiber (single mode fiber) such as SMF-28 ULL fiber or SMF-28e fiber, InfiniCor® series Fibers (multimode fiber).

When an acoustic event occurs downhole in the wellbore 14 at any point along the optical fiber 15, the strain induces a transient distortion in the optical fiber 15 and changes the refractive index of the light in a localized manner, thus altering the pattern of backscattering observed in the absence of the event. The Rayleigh band is acoustically sensitive, and a shift in the Rayleigh band is representative of an acoustic event downhole. To identify such events, a "CR interrogator"

injects a series of light pulses as a predetermined wavelength into one end of the optical fiber, and extracts backscattered light from the same end. The intensity of the returned light is measured and integrated over time. The intensity and time to detection of the backscattered light is also a function of the distance to where the point in the fiber where the index of refraction changes, thus allowing for determination of the location of the strain-inducing event. A series of locations along the optical fibre cable 15 (and thus along the wellbore A) can be monitored simultaneously using known time division multiplexing techniques, which will not further be discussed here.

Figure 2:
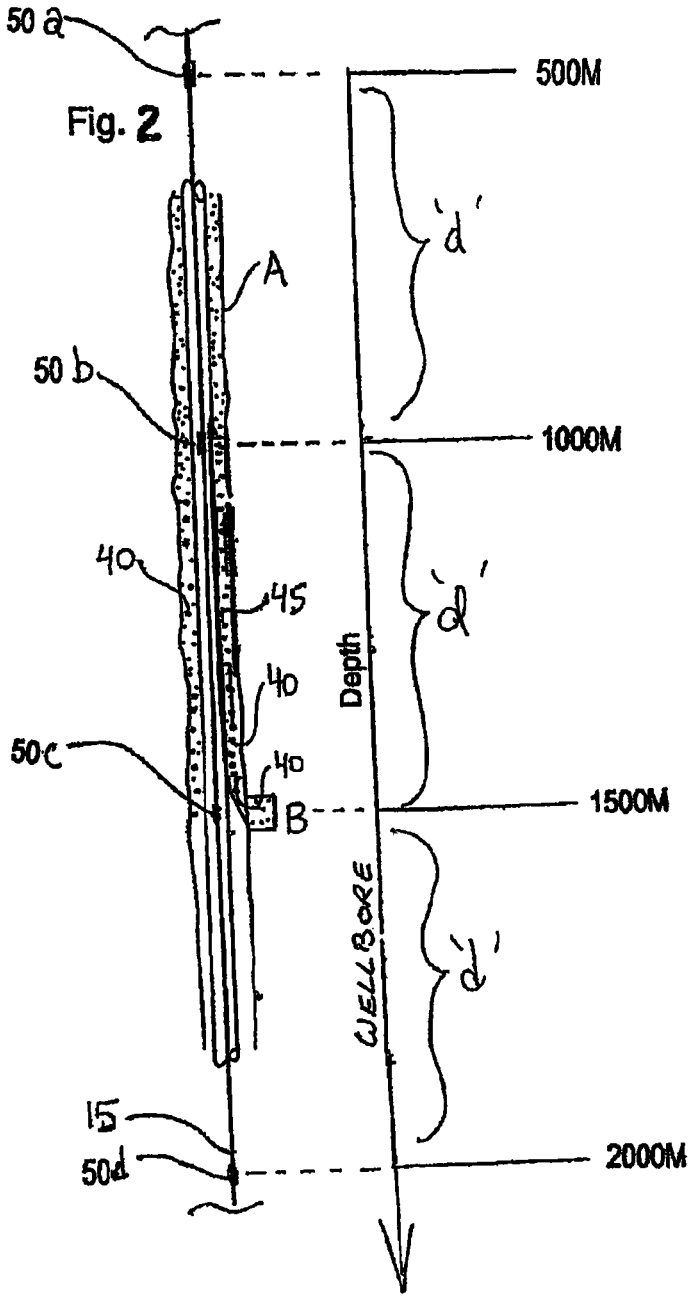
FIG. 2 is a schematic detailed cross-sectional view of a wellbore, showing the location A of fluid ingress, and various acoustic sensing locations located at depths of 0 m, 500 m, 1000 m, 1500 m, and 2000 m within the wellbore.

Referring to FIG. 2, such shows a section of an abandoned wellbore A [specifically a section of wellbore A spanning approximately 1500 m (i.e., from 500 to 2000 m)], having an acoustic sensing means in the form of a fibre optic cable 15 suspended in such portion of the wellbore A, and within production casing 45 therein.

Fibre optic cable 15 (i.e., acoustic sensing means) is adapted, via signal processing equipment shown schematically as 26 in FIG. 1, to process acoustic signals received from locations 50*a*, 50*b*, 50*c*, and 50*d* along said fibre optic cable 15 (i.e., at corresponding respective depths of 500 m, 1000 m, 1500 m and 2000 m) within wellbore A.) Alternatively, the acoustic sensing means may comprise a plurality of microphones 49 (not shown), located at various spaced locations 50*a*, 50*b*, 50*c*, and 50*d* along cable 15 which transmits acoustic signals 80*a*, 80*b*, 80*c*, 80*d* received therefrom to surface, and in particular to data acquisition unit 24 and signal processing equipment 26 on surface (see FIG. 1).

A source of fluid ingress 40 is shown at location B along wellbore A, at a depth of 1500 m. As shown in FIG. 2, the fluid ingress 40 is in the form of gas bubbles which enter the wellbore A between the production casing 45 and the wellbore A and rise to surface in the direction of the arrows shown. However, such fluid ingress 40 could take various other forms, and occur at one or more various other depths in wellbore A.

Figure 3:
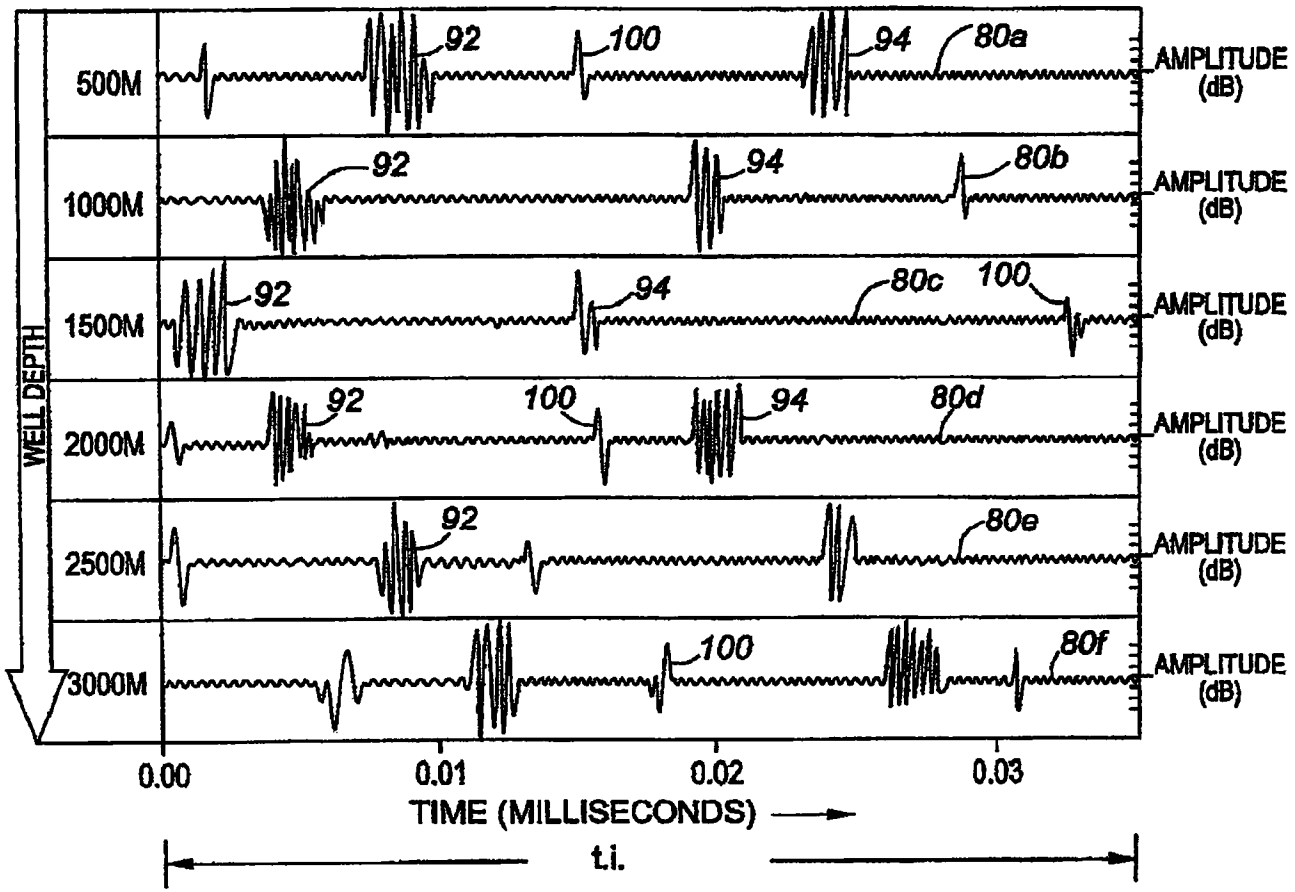
FIG. 3 is a schematic depiction, in amplitude versus time format, of six (6) separate acoustic signals received from acoustic sensing means located at corresponding depths of 0 m, 500 m, 1000 m, 1500 m 2000 m, 2500 m in a wellbore, where there is a disguised common event in each of said six (6) acoustic signals due to a fluid ingress occurring at a dept of 1500 m in the wellbore.

FIG. 3 shows representative graphical representations of logged acoustic signals 80*a*, 80*b*, 80*c*, 80*d*, 80*e*, and 80*f*, in amplitude versus time format, which were logged over an identical time interval "t.i." of approximately 0.035 milliseconds from various depths of wellbore A in FIG. 2 which as shown in FIG. 2 is experiencing fluid ingress (i.e., a leak) at a depth of 1500 m. The selected time interval "t.i." is an interval of time which is a sufficiently large time interval to capture a number of common components 92,94 in the various acoustic signals 80*a*, 80*b*, 80*c*, 80*d*, 80*e*, and 80*f*, but is as small as possible to ease the burden of searching for common components 92,94 in such acoustic signals 80*a*, 80*b*, 80*c*, 80*d*, 80*e*, and 80*f*. In the example shown, the selected time interval "t.i." was approximately 0.035 milliseconds, but of course such time interval be selected to be different, depending on various conditions and factors, including such factors as the nature of the acoustic signal generated by the leak, the temperature and thus the various speed at which sound travels, and/or selected spacing distance "d" along the wellbore A of the location of the acoustic signals 80*a*, 80*b*, 80*c*, 80*d*, 80*e*, and 80*f*. In practice, iterative logging of acoustic signals 80*a*, 80*b*, 80*c*, 80*d*, 80*e*, and 80*f* over various time intervals t.i. may be necessary in order to select a time interval sufficiently large to capture a number one or more common components 92,94 in the various acoustic signals 80*a*, 80*b*, 80*c*, 80*d*, 80*e*, and 80*f*, but as small as possible to ease the burden of searching for common components 92,94 in such acoustic signals.

FIG. 3 shows a graphical representations from only six (6) acoustic sensing locations 50*a*, 50*b*, 50*c*, 50*d* (i.e., 500 m, 1000 m, 1500 m, and 2000 m respectively) as well as from two further depths of 2500 m (50*e*) and 3000 m (50*f*) for the purpose of illustrating the method of the present invention. However, in practice and in a preferred embodiment, in order to more accurately locate the precise location of a leak in a wellbore A, many acoustic signals 80*a*, 80*b*, 80*c*, 80*d*, 80*e*, 80*f*, etc. will be simultaneously logged from hundreds of sensor locations 50, 50*b*, 50*c*, 50*d*, etc regularly spaced along the length of wellbore A, each providing an acoustic signal 80 over a defined time interval t.i. For example, for a wellbore of a depth of 1500 m (i.e., 4920 ft), in practice and in a preferred embodiment acoustic signals 80*a*, 80*b*, 80*c*, 80*d*, 80*e*, 80*f*, etc would be sensed from hundreds of regularly spaced locations 50, 50*b*, 50*c*, 50*d*, etc along the length of the wellbore A, in order to more precisely determine the location of a leak and thus reduce the amount and cost of cement injected downhole at the desired location to seal the leak.

Figure 4:
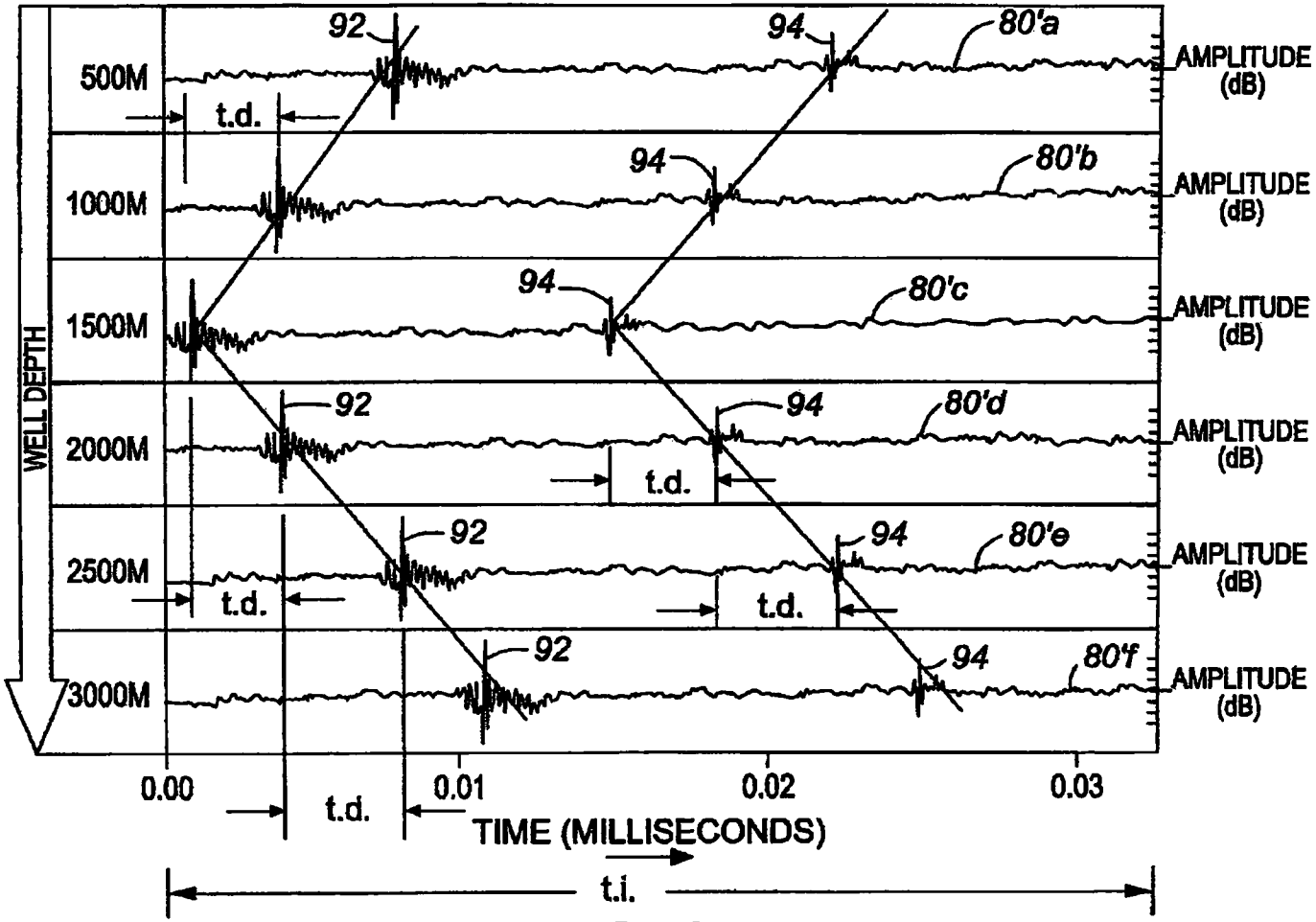
FIG. 4 is a view of the six (6) separate acoustic signals shown in FIG. 3 which signals have each further been analyzed by applying a filter technique analysis to eliminate non-common elements, to reveal two common components in each signal, which due to the earliest phase angle of the common component being contained in the acoustic signal emanating from the acoustic sensing means located at 1500 m indicates the source of the acoustic event (and likely fluid ingress) being at a depth of 1500 m in the wellbore.

As may be seen from the typical graphical representations of FIG. 3, while common elements 92,94 are present in acoustic signals 80*a*, 80*b*, 80*c*, 80*d*, 80*e*, 80*f* (see same acoustic signals 80'*a*, 80'*b*, 80'*c*, 80'*d*, 80'*e*, 80'*f*, after the method of the present invention, as shown in FIG. 4, showing common components 92, 94), such common signal components 92, 94 are disguised in the raw acoustic signals 80*a*, 80*b*, 80*c*, 80*d*, 80*e*, 80*f* shown in FIG. 3 by other random noise components 100, which may emanate from surface noise or other random disturbances.

Using the method of the present invention, the raw acoustic signals 80*a*, 80*b*, 80*c*, 80*d*, 80*e*, 80*f* of FIG. 3 are analyzed using known signal processing techniques, such as filtering as more fully explained below, to determine common components 92,94. Importantly, to be determined to be a common component, such common component must appear and be repeated in at least two, and preferably three, and more preferably a greater number, of acoustic signals 80*a*, 80*b*, 80*c*, 80*d*, 80*e*, 80*f* received from proximate locations 50*a*, 50*b*, 50*c*, 50*d* along wellbore A, but each with a common known time delay "t.d." between the time of appearance of a particular component 92,94 in each successive acoustic signal 80. Such known time delay "t.d." is the time for sound to travel, at a certain temperature in a medium such as steel or air, the distance "d" (see FIG. 2) by which each of the acoustic signals 80*a*, 80*b*, 80*c*, 80*d*, 80*e*, 80*f* are separated along wellbore A. In such manner the common components of each signal may be determined. Other means of signal analysis will now occur to persons of skill in the art, to determine common components of signals. Such analysis may further include, for the purposes of identifying common components of a signal, any one or more known acoustic analysis techniques comprising: (i) an analysis of such acoustic signal with regard to amplitude of such acoustic signal over said time interval; (ii) a frequency analysis; (iii) a power analysis examining power as a function of frequency; (iv) a fast fourier transform; (v) a root-mean-square analysis of amplitude over time; (vi) a means/variance analysis; (vii) a spectral centroid analysis, or (viii) a filter analysis, such as and including a bandpass filter technique.

FIG. 4 shows acoustic signals 80'*a*, 80'*b*, 80'*c*, 80'*d*, 80'*e*, 80'*f*, which are the same acoustic signals 80*a*, 80*b*, 80*c*, 80*d*, 80*e*, 80*f* of FIG. 3 but which were analyzed (in this case filtered) to remove random extraneous noise components 100, so as to leave remaining common components 92,94 in each acoustic signal 80'*a*, 80'*b*, 80'*c*, 80'*d*, 80'*e*, 80'*f*, each of such common components 92,94 delayed in time by amount of time "t.d." relative to the appearance of common component in an adjacent signal 80'*a*, 80'*b*, 80'*c*, 80'*d*, 80'*e*, 80'*f*. In a preferred embodiment, each of such common components may be labeled in the acoustic signal data 80*a*, 80*b*, 80*c*, 80*d*, 80*e*, 80*f*, to aid in being able to discern such common components 92,94 from the remainder of acoustic signals 80*a*, 80*b*, 80*c*, 80*d*, 80*e*, 80*f* and/or such acoustic signals filtered to remove extraneous signals 100 to produce acoustic signals 80'*a*, 80'*b*, 80'*c*, 80'*d*, 80'*e*, 80'*f*, and such modified signals 80'*a*, 80'*b*, 80'*c*, 80'*d*, 80'*e*, 80'*f* graphically represented and common components 92,94 individually color-coded when displayed, as shown in FIG. 4, to more clearly observe the determined common components 92,94 and to permit the determination of which acoustic signal 80'*a*, 80'*b*, 80'*c*, 80'*d*, 80'*e*, 80'*f* has the earliest phase angle.

As may be seen from FIG. 4, acoustic signal 80'*c*, generated from a depth of 1500 m is the acoustic signal which possesses common acoustic signal components 92, 94 having the earliest phase angle, and thus by the method of the present invention the 1500 m depth is thus the location in the wellbore A which likely has a source of fluid ingress.

Figure 5:
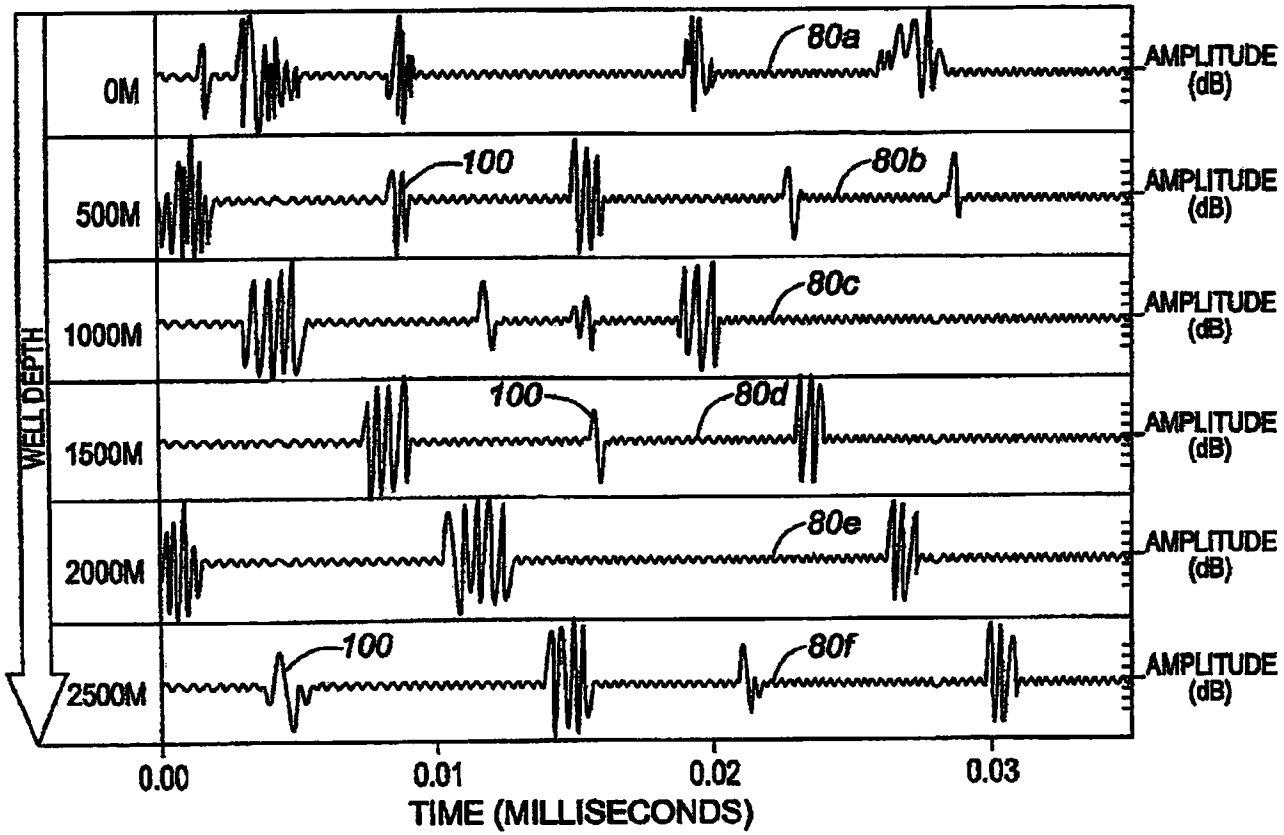
FIG. 5 is a schematic depiction, in amplitude versus time format, of six (6) separate acoustic signals received from acoustic sensing means located at corresponding depths of 0 m, 500 m, 1000 m, 1500 m 2000 m, 2500 m in a wellbore, where there is a disguised common event in each of said six (6) acoustic signals due to a fluid ingress occurring at a dept of 500 m in the wellbore.

FIG. 5 is a graphical representation similar to that of FIG. 3, showing a series of acoustic signals 80*a*, 80*b*, 80*c*, 80*d*, 80*e*, 80*f* obtained from a wellbore A which is suspected to be experiencing ingress of fluid at an unknown depth, showing such signals in amplitude versus time format.

Figure 6:
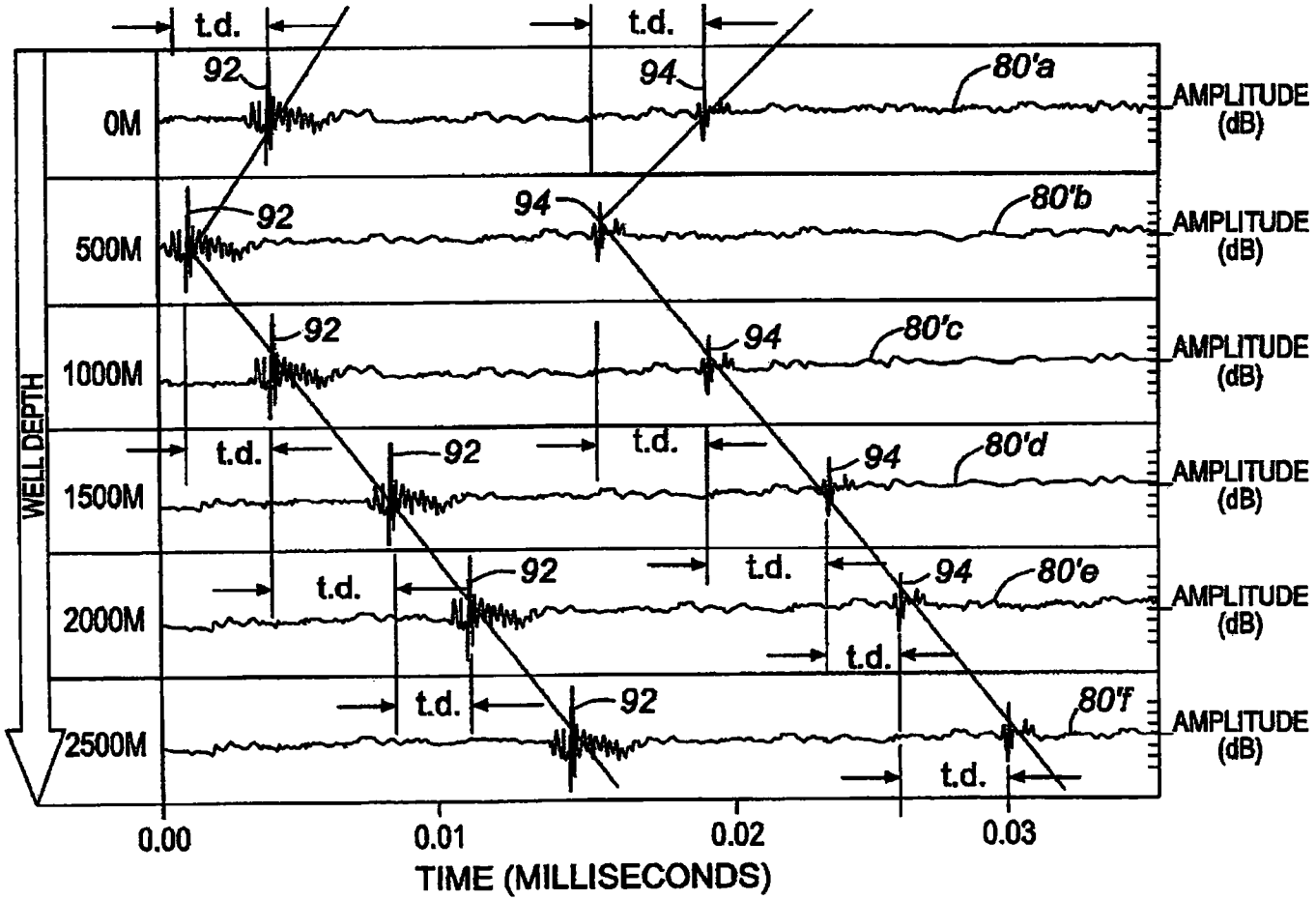
FIG. 6 is a view of six (6) separate acoustic signals of FIG. 5 which have each further been analyzed by applying a filter technique analysis to eliminate non-common elements and to reveal at least two common components in each signal, which due to the earliest phase angle of the common two components being contained in the acoustic signal emanating from the acoustic sensing means located at 500 m, such indicates the source of the acoustic event (and likely fluid ingress) being at a depth of 500 m in the wellbore.

FIG. 6 is a graphical representation of acoustic signals 80'*a*, 80'*b*, 80'*c*, 80'*d*, 80'*e*, 80'*f* which are the same acoustic signals 80*a*, 80*b*, 80*c*, 80*d*, 80*e*, 80*f* of FIG. 5, but which have been analyzed by the method of the present invention so as to ascertain common components 92,94 therein which exhibit a uniform time delay "t.d" between such common components 92,94 in each acoustic signal 80'*a*, 80'*b*, 80'*c*, 80'*d*, 80'*e*, 80'*f*.

By the method of the present invention, namely identifying the acoustic signal 80'*b* having the common components 92,94 having the earliest phase angle, a depth of 500 m in wellbore A is determined to be the location likely having fluid ingress, and such depth being the location generating an acoustic event containing common acoustic signal components 92 & 94.

Figure 7:
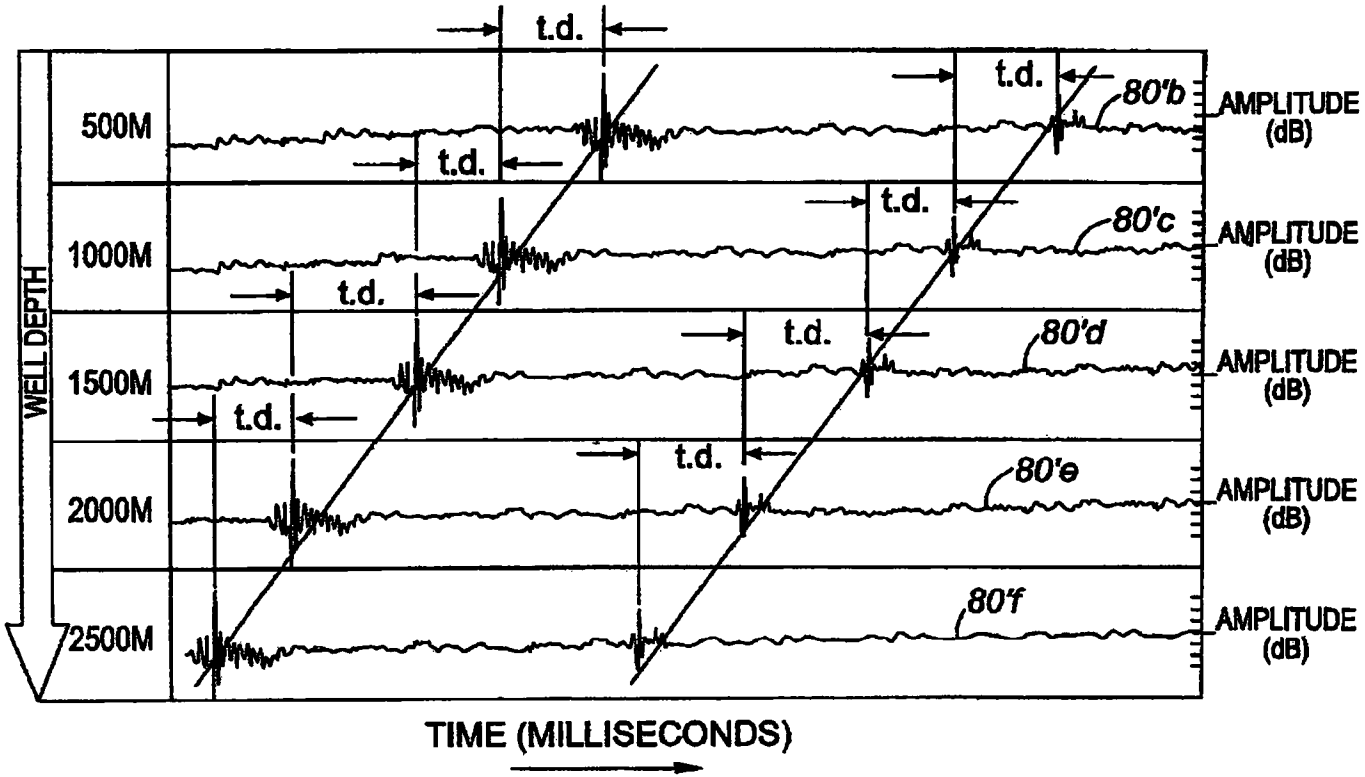
FIG. 7 is a view of six (6) separate acoustic signals which have each further been analyzed by applying a filter technique analysis to eliminate non-common elements, to reveal two common components in each signal, which due to the earliest phase angle of the common component being contained in the acoustic signal emanating from the acoustic sensing means located at 2500 m, such indicates the source of the acoustic event (and likely fluid ingress) being at a depth of 2500 m in the wellbore.

FIG. 7 is a graphical representation similar to that of FIG. 6, showing a series of acoustic signals 80'*b*, 80'*c*, 80'*d*, 80'*e*, 80'*f*, which comprise a series acoustic signals 80'*b*, 80'*c*, 80'*d*, 80'*e*, 80'*f* which have been analyzed by the method of the present invention so as to ascertain common components 92,94 therein which exhibit a uniform time delay "t.d" between such common components 92,94 in each acoustic signal 80'*a*, 80'*b*, 80'*c*, 80'*d*, 80'*e*, 80'*f*.

By the method of the present invention, namely identifying the acoustic signal 80'*f* having the common components 92,94 having the earliest phase angle, a depth of 2500 m in wellbore A is determined to be the location likely having fluid ingress, and such depth being the location generating an acoustic event containing common acoustic signal components 92 & 94.

Figure 8:
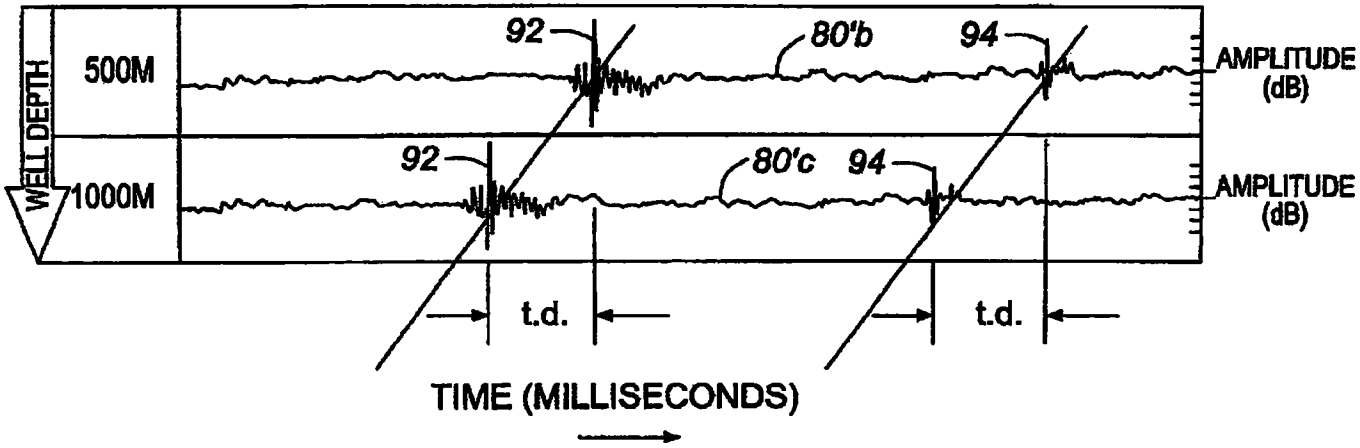
FIG. 8 is a view of two (2) separate acoustic signals which have each further been analyzed by applying a filter technique analysis to eliminate non-common elements and to illustrate at least two common elements in each signal, and which accordingly then provides an indication of where along said wellbore said fluid ingress is occurring, namely potentially at some depth below 1000 m.

FIG. 8 is a graphical representation similar to that of FIG. 6, showing a pair of acoustic signals 80'*b*, 80'*c* which have been analyzed by the method of the present invention so as to ascertain common components 92,94 therein which exhibit a uniform time delay "t.d" between such common components 92,94 in each acoustic signal 80'*b*, 80'*c*. Such pair of acoustic signals 80'*b*, 80'*c* are derived from a pair of raw acoustic signals 80*b*, 80*c* emanating from proximate locations along a wellbore A, such as would be obtained if a pair of microphones separated by a fixed (known) distance of 500 m were lowered into a wellbore A.

Using the method of the present invention, an indication of where along said wellbore said fluid ingress is occurring can be determined, namely from a recognition that the components 92,94 have the earliest phase angle in signal 80"*c*, namely at 1000 m. Thus the acoustic event exhibited by acoustic components 92, 94 is emanating from at or below a depth of 1000 m in wellbore A. Such pair of microphones could then be further lowered, and similar readings obtained, to better determine the location of the leak (fluid ingress) in the well. Clearly, if more than two microphones were used and more than two acoustic signals generated, the location of leak could be determined with greater accuracy.

Figure 9:
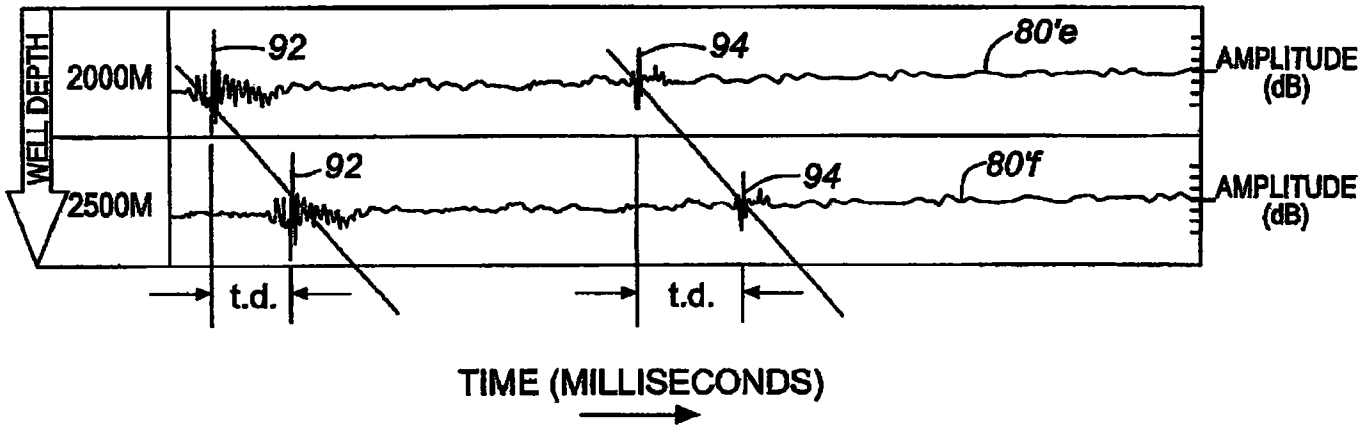
FIG. 9 is a view of two (2) separate acoustic signals which have each further been analyzed by applying a filter technique analysis to eliminate non-common elements and to illustrate at least two common elements in each signal, and which accordingly then provides an indication of where along said wellbore said fluid ingress is occurring, namely potentially at a depth of 2000 m.

FIG. 9 is a graphical representation similar to that of FIG. 8, showing a pair of acoustic signals 80'*e*, 80'*f* which have been analyzed by the method of the present invention so as to ascertain common components 92,94 therein which exhibit a uniform time delay "t.d" between such common components 92,94 in each acoustic signal 80'*e*, 80'*f*. Such pair of acoustic signals 80'*e*, 80'*f* are derived from a pair of raw acoustic signals 80*b*, 80*c* emanating from proximate locations along a wellbore A, such as would be obtained if a pair of microphones separated by a fixed (known) distance of 500 m were lowered into a wellbore A.

Using the method of the present invention, an indication of where along said wellbore A said fluid ingress is occurring can be determined, namely from a recognition that the components 92,94 have the earliest phase angle in signal 80'*e*, namely at 2000 m.

Thus the acoustic event exhibited by acoustic components 92, 94 is determined to be emanating from at or above a depth of 2000 m in wellbore A.

Such pair of microphones could then be raised or lowered, and similar readings obtained and the above process of analysis of the resultant signals again conducted, to better determine the location of the leak (fluid ingress) in the well 14.

Example 1

A simulated wellbore having a source of fluid ingress was created. Specifically, vertical sections of 4½ inch (outside diameter) lengths of ¼ inch steel pipe were co-axially placed within vertical sections of 6 inch (outside diameter) lengths of steel pipe, and the respective sections welded together to form a simulated wellbore of 43 m in length, having an inner annulus between the pipe diameters of approximately 1 inch simulating a distance between a casing in a wellbore, and an exterior of the wellbore.

Fluid (water) at approximately 20° C. was bubbled into the above annulus via a 1/16 inch aperture in the exterior 6 inch pipe, at a rate of approximately 5 ml per minute, at a location 25 m along a vertical length of such pipe (measured from the base when such simulated wellbore was in the vertical position-hereinafter all dimensions from the base of such structure).

A simulated obstruction was placed in the formed annulus, at a location of 15 m along the vertical length of such pipe (i.e., 15 m from the base).

A fibre optic cable, having two acoustic sensing means therein, for sensing acoustic signals was utilized. Such fibre optic cable was manufactured by Hi-Fi Engineering Inc., of Calgary, Alberta, and was specifically manufactured for purposes of sensing acoustic signals in wellbores.

Specifically a time division multiplexer interrogator, manufactured by Optiphase Inc., and a OPD 4000 demodulator having a demodulation rate of 37 kHz, which further comprises an OPD-440P (with PDR receiver made by Optiphase Inc.,) and as more fully described in WO 2008/098380 was used to receive the fibre optic signals, and convert them into acoustic signals.

A CS laser (manufactured by Orbits Lightwave, of Pasadena Calif.), was used as the laser light source.

The above fibre optic cable was suspending centrally within the above simulated wellbore, and acoustic signals obtained simultaneously from two locations located respectively 6 m and 8 m below the location of fluid ingress along the pipe (i.e., at a location of 19 m and 17 m from the base).

An acoustic signal having a plurality of significant amplitudes separated by periods of little acoustic significance were obtained, which were thought to correspond to the intermittent bubbling of fluid (water) into the wellbore via the 1/16 inch aperture.

A period of approximately 0.03 milliseconds (i.e., 2.620-2.650) was selected as a time interval, which captured a single significant event from each of the two acoustic signals from each of the two locations in the wellbore.

Figure 10:
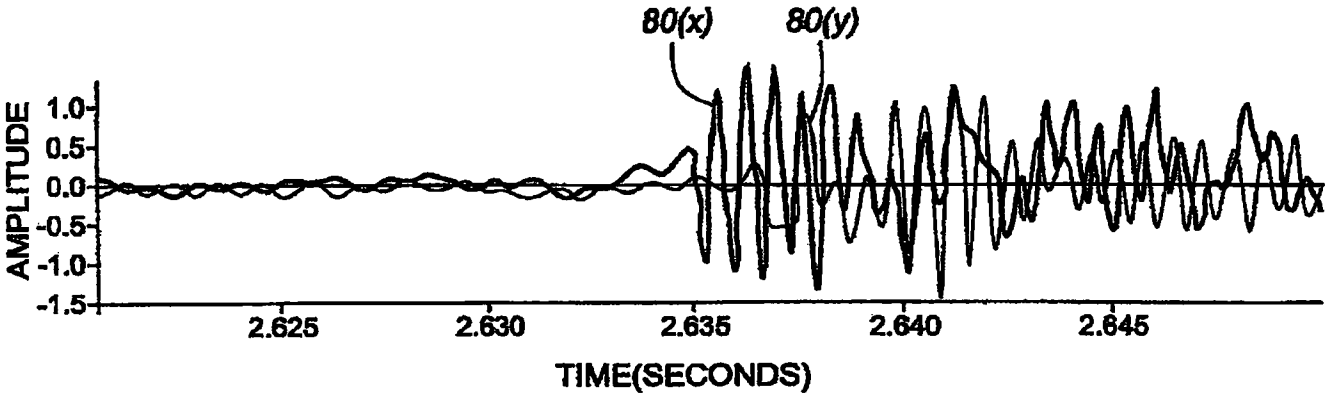
FIG. 10 is a graphical representation [in amplitude versus time format] of two acoustic signals generated in the manner described in Example 1 herein, where such two sensors were spaced 2 m apart and spaced respectively 6 m and 8 m above a source of fluid ingress in a simulated wellbore.

FIG. 10 graphically represents the aforesaid two signals, with acoustic signal 80($x$) being the acoustic signal received from the 18 m location along the simulated wellbore and being the location closest the location of fluid ingress at 25 m as measured from the top of the pipe, and acoustic signal 80($y$) being the acoustic signal received from the 16 m location along the simulated wellbore and being the location the farthest of the two from the location of fluid ingress at 25 m.

As may be seen from FIG. 10, acoustic signal 80($x$), being located only 7 m from the source of fluid ingress in the simulated wellbore, provided the signal which was earliest in phase, and thus accordingly in accordance with the method of the present invention correctly determined it to be closest the source of fluid ingress in the wellbore.

The aforementioned steps were repeated with the fibre optic cable in the simulated wellbore being lowered to a position below the location of fluid ingress at 25 m, namely to a position wherein acoustic signals could be obtained from positions of 33 m and 35 m respectively from the top of the wellbore, and accordingly 8 m and 10 m respectively below the source of fluid ingress at 25 m.

An acoustic signal having a plurality of significant amplitudes separated by periods of little acoustic significance were obtained, which were thought to correspond to the intermittent bubbling of fluid into the well.

A period of approximately 30 milliseconds (i.e., 1.745-1.775 seconds) was selected as a time interval, which captured a single significant event from each of the two acoustic signals from each of the two locations in the wellbore.

Figure 11:
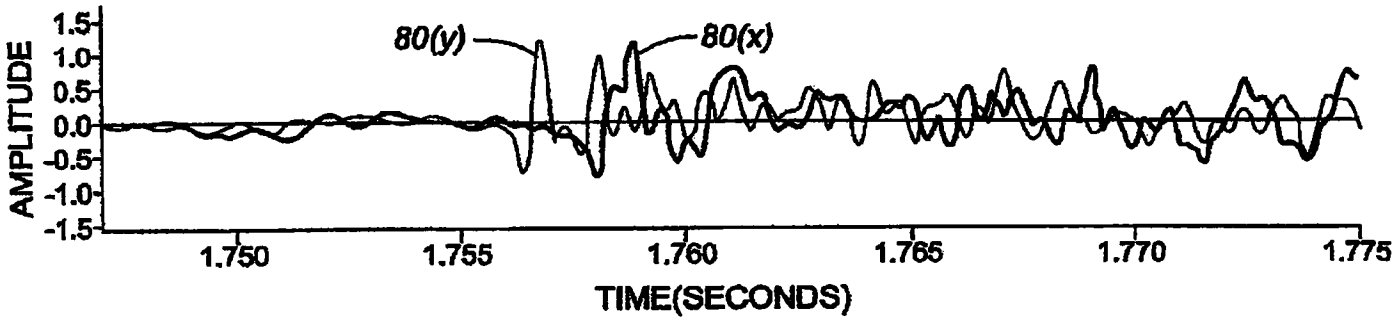
FIG. 11 is a graphical representation [in amplitude versus time format] of two acoustic signals generated in the manner described in Example 1 herein, where such two sensors were spaced 2 m apart and spaced respectively 8 m and 10 m below a source of fluid ingress in said simulated wellbore.

FIG. 11 graphically represents the aforesaid two signals, with acoustic signal 80($x$) now being the acoustic signal received from the 35 m location along the simulated wellbore and being the location farthest (i.e., 10 m) from the location of fluid ingress at 25 m as measured from the top of the pipe, and acoustic signal 80($y$) being the acoustic signal received from the 33 m location along the simulated wellbore and being the location the closest (i.e., 8 m) of the two to the location of fluid ingress at 25 m.

As may be seen from FIG. 11, acoustic signal 80($y$), being located 8 m from the source of fluid ingress in the simulated wellbore, provided the signal which was earliest in phase and thus accordingly in accordance with the method of the present invention correctly determined it to be closest the source of fluid ingress in the wellbore as opposed to acoustic signal 80($x$) received from the location 35 m along the wellbore, thus correctly determining the leak (source of fluid ingress) to be correctly emanating from a position less than 33 m from the top of the well.

Example 2

The aforementioned steps of Example 1 were repeated with the fibre optic cable in the simulated wellbore being lowered to a position below the location of fluid ingress at 25 m, namely to a position wherein acoustic signals could be obtained from positions of 38 m and 40 m respectively from the top of the wellbore, and accordingly 13 m and 15 m respectively below the source of fluid ingress at 25 m.

An acoustic signal having a plurality of significant amplitudes separated by periods of little acoustic significance were obtained from each of the aforementioned positions in the wellbore. It was considered that the above type of acoustic signal corresponded to and was representative of intermittent bubbling of fluid into the well.

A bandpass filter was used so as to pass acoustic signals with a frequency in the specific low frequency range of 200 Hz partial filtering of the acoustic signals to only low the low frequency range was desirable in view of the fact fluid ingress is typically of a low frequency (i.e., 100 to 2000 Hz) frequency range. It is thus typically desirable (and makes signal analysis to determine earliest phase considerably easier) by conducting such an initial filtering step since higher frequency acoustic signal components (such as often caused by surface noise) are thereby filtered out of the acoustic signals to by analyzed. A period of approximately 20 milliseconds (i.e., 8.210-8.230 seconds) was selected as the time interval, which captured a single significant event from each of the two acoustic signals from each of the two locations in the wellbore.

Figure 12:
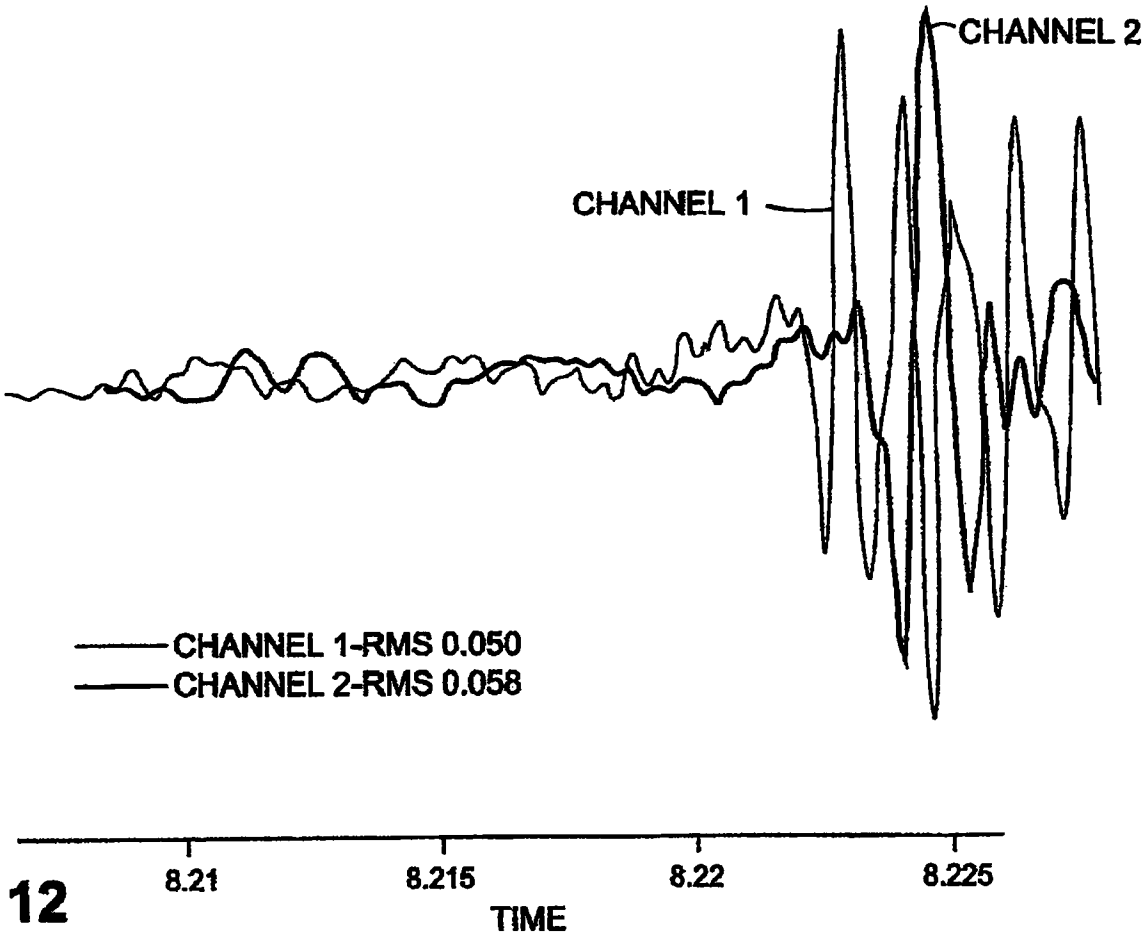
FIG. 12 is a graphical representation of two acoustic signals, with the acoustic signal received on channel 1 emanating from a location in said simulated wellbore closest the location of fluid ingress and having an RMS signal value of 0.050, with the channel 2 acoustic signal shown emanating from a location in said simulated wellbore farthest from the location of fluid ingress and having an RMS signal value of 0.058.

FIG. 12 graphically represents the resulting aforesaid signals over the selected time interval, using the 200 Hz to 2000 Hz bandpass filter, with channel 1 (ch. 1) being the acoustic signal received from the 38 m location along the simulated wellbore and being the location closest (i.e., 13 m) from the location of fluid ingress at 25 m as measured from the top of the pipe, with channel 2 (ch. 2) being the acoustic signal received from the 40 m location along the simulated wellbore and being the location the farthest (i.e., 15 m) of the two to the location of fluid ingress at 25 m.

As may be seen from FIG. 12, acoustic signal on ch. 1 being located 13 m from the source of fluid ingress in the simulated wellbore, provided the signal which was earliest in phase and thus accordingly in accordance with the method of the present invention correctly determined it to be closest the source of fluid ingress in the wellbore as opposed to acoustic signal received on ch. 2 received from the location 40 m along the wellbore. Importantly, a power analysis of the two received signals, namely a root-mean-square (RMS) analysis of each of the two signals was conducted (conducted using Matlab®), with the RMS value over the given interval for the acoustic signal received on ch. 1 computed as 0.050, with the corresponding RMS value over the given interval for the acoustic signal received on ch. 2 computed as 0.058. Note that the method of the present invention of using earliest phase is the more accurate predictor of proximity to fluid ingress, than is the relative power of the received signal.

Example 3

The acoustic signals of Example 2 were examined, at a different time, namely at a point in time having another single significant event from each of the two acoustic signals from each of the two locations, over a period of approximately 30 milliseconds (i.e., 4.220-4.250 seconds) which was selected as the time interval.

Figure 13:
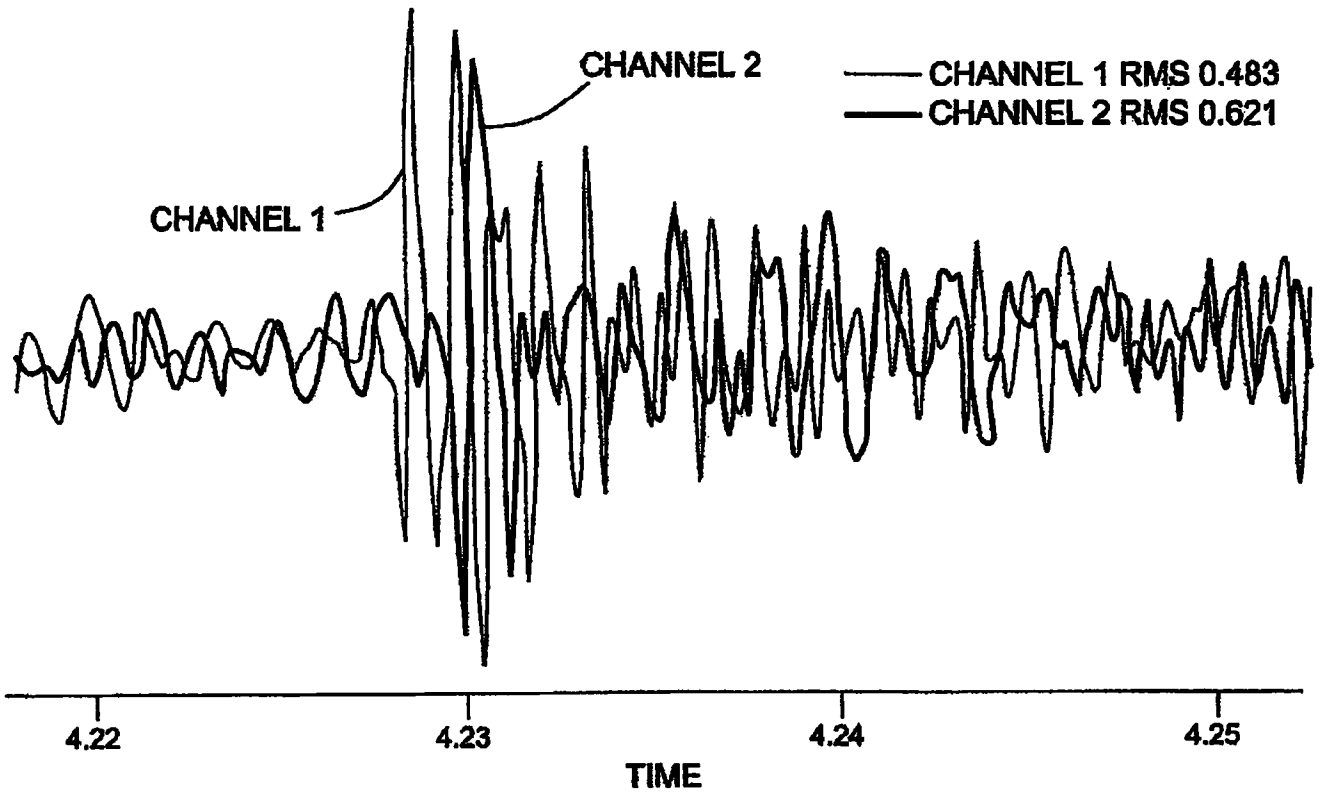
FIG. 13 is a graphical representation of two acoustic signals, with the ch. 1 acoustic signal emanating from a location in said simulated wellbore closest the location of fluid ingress and having an RMS signal value of 0.483, with the ch. 2 acoustic signal shown emanating from a location in said simulated wellbore farthest from the location of fluid ingress and having an RMS signal value of 0.621.

FIG. 13 graphically represents the aforesaid signals over time, with channel 1 (ch. 1) being the acoustic signal received from the 38 m location along the simulated wellbore and being the location closest (i.e., 13 m) from the location of fluid ingress at 25 m as measured from the top of the pipe, with channel 2 (ch. 2) being the acoustic signal received from the 40 m location along the simulated wellbore and being the location the farthest (i.e., 15 m) of the two to the location of fluid ingress at 25 m.

As may be seen from FIG. 13, acoustic signal on ch. 1 being located 13 m from the source of fluid ingress in the simulated wellbore, provided the signal which was earliest in phase and thus accordingly in accordance with the method of the present invention correctly determined it to be closest the source of fluid ingress in the wellbore as opposed to acoustic signal received on ch. 2 received from the location 40 m along the wellbore. Importantly, a power analysis of the two received signals, namely a root-mean-square (RMS) analysis of each of the two signals was conducted, using Matlab®, with the RMS value over the given interval for the acoustic signal received on ch. 1 computed as 0.483, with the corresponding RMS value over the given interval for the acoustic signal received on ch. 2 computed as 0.621. Note that the method of the present invention of using earliest phase is the more accurate predictor of proximity to fluid ingress, than is the relative power of the received signal.

The present invention has been described with regard to one or more embodiments. Various permutations will now be readily apparent to a person of skill in the art, and in particular a person of skill in the art of acoustic signal analysis and processing, and that a number of variations and modifications can be made without departing from the scope of the invention as defined in the claims.

What is claimed is:

1. A method for detecting fluid ingress in a wellbore and obtaining an indication of where along said wellbore said fluid ingress is occurring, the method comprising:

(a) placing acoustic sensing means along at least a portion of said wellbore, said acoustic sensing means adapted to sense individual acoustic signals from a plurality of known proximate locations along said wellbore;

(b) receiving at least three acoustic signals from said acoustic sensing means over a selected time interval, each of said received acoustic signals having associated therewith one of said proximate locations;

(c) identifying at least a common acoustic component in said received acoustic signals by analyzing each of said received acoustic signals received over said selected time interval, wherein said identifying comprises identifying as said common acoustic component an acoustic component that exhibits a uniform time delay in said received acoustic signals; and (d) identifying, as a lead acoustic signal, one of said acoustic signals that possesses said common acoustic component, wherein said common acoustic component is at an earlier point in time compared to said common acoustic component in said rest of acoustic signals received from said proximate locations above and below said location that receives said lead acoustic signal, wherein said proximate location that receives said lead acoustic signal is indicative of where along said wellbore said fluid ingress is occurring.

2. The method of claim 1, wherein said proximate locations are regularly spaced along said wellbore.

3. The method of claim 1, wherein prior to step c) said received signals are first filtered via a bandpass filter adapted to pass only low-frequency acoustic signals in a frequency range of 100 to 2000 Hz.

4. The method of claim 1, wherein:

step (a) includes placing said acoustic sensing means along substantially an entire length of said wellbore.

5. The method of claim 1, wherein said locations are individually spaced apart by less than the distance determined by the speed of sound in steel or air at the wellbore temperature multiplied by the selected time interval.

6. The method of claim 1, further comprising the step of labeling said common acoustic component in each of said acoustic signals.

7. The method of claim 6, wherein said step of labeling said common acoustic component comprises creating an amplitude versus time representation of each acoustic signal, and color coding said common acoustic component in each of said acoustic signal.

8. The method of claim 1, further comprising the steps of:

(i) creating a visual representation, in amplitude versus time format, of each acoustic signal over said selected time interval;

(ii) color coding each identified common acoustic component of each acoustic signal with a similar color; and (iii) determining, from said graphic representation of said acoustic signals which particular acoustic signal is said lead acoustic signal and thereby determining said location in said wellbore having fluid ingress.

9. The method of claim 1, wherein said acoustic sensing means is a fibre optic cable.

10. The method of claim 9, wherein said step of receiving said acoustic signals from said acoustic sensing means over said selected time interval comprises the use of time division multiplexing techniques.

11. The method of claim 1, wherein said step of analyzing each of said received acoustic signals comprises conducting an analysis selected from the group of analysis techniques comprising (i) an analysis of such signal with regard to amplitude of such acoustic signal over said time interval; (ii) a frequency analysis; (iii) a power analysis examining power as a function of frequency; (iv) a fast Fourier transform; (v) a root-mean-square analysis of amplitude over time; (vi) a means/variance analysis; (vii) a spectral centroid analysis; and (viii) a filter analysis so as to select only certain frequencies for the acoustic signals to be analyzed; and a combination of any of the foregoing.

12. The method of claim 1, wherein said acoustic sensing means comprises at least three microphones.

13. The method of claim 1, wherein after having conducted steps (a) to (d), said process is repeated placing said acoustic sensing means along another portion of said wellbore.

14. A method for detecting fluid ingress in a wellbore and determining a location in said wellbore of said fluid ingress, the method comprising:

(a) placing acoustic sensing means along at least a portion of said wellbore, said acoustic sensing means adapted to sense at least three acoustic signals from at least three corresponding separately spaced apart proximate locations along a length of said wellbore;

(b) receiving said at least three acoustic signals from said acoustic sensing means over a selected time interval, each of said received acoustic signals having associated therewith one of said proximate locations;

(c) identifying at least one common acoustic component contained in said received acoustic signals by analyzing each of said received acoustic signals received over said selected time interval, wherein said identifying comprises identifying as said common acoustic component an acoustic component that exhibits a uniform time delay in said received acoustic signals;

(d) displaying a graphic representation depicting each of said acoustic signals in an amplitude versus time representation, with time incrementally increasing from left to right and successively arranged one above the other indicating their respective location in said wellbore;

(e) color coding, in each of said acoustic signals which said one common acoustic component appears, said at least one common acoustic component in a color different from a remaining graphic representation of said acoustic signals; and (f) determining the color coded component in each of the graphically represented acoustic signals which is located closest the left of the graphical depictions, thereby identifying, as a lead acoustic signal, one of said acoustic signals that possesses said common acoustic component, wherein said common acoustic component is at an earlier point in time compared to said common acoustic component in said rest of acoustic signals received from said proximate locations above and below said location that receives said lead acoustic signal, wherein the location that receives said lead acoustic signal is indicative of where along said wellbore said fluid ingress is occurring.

15. The method of claim 14, wherein said proximate locations are regularly spaced along said wellbore.

16. A method for detecting fluid ingress in a wellbore and obtaining an indication of where along said wellbore said fluid ingress is occurring, the method comprising:

(a) receiving at least three acoustic signals from acoustic sensing means positioned along at least a portion of a wellbore, each of said at least three acoustic signals generated over an identical selected time interval and each of said at least three acoustic signals having associated therewith a corresponding known proximate location along said wellbore;

(b) identifying at least a common acoustic component in said acoustic signals received from proximate locations in said wellbore by analyzing each of said received acoustic signals received over said selected time interval, wherein said identifying comprises identifying as said common acoustic component an acoustic component that exhibits a uniform time delay in said received acoustic signals; and (c) identifying, as a lead acoustic signal, one of said acoustic signals that possesses said common acoustic component, wherein said common acoustic component is at an earlier point in time compared to said common acoustic component in said rest of acoustic signals received from said proximate locations above and below said location that receives said lead acoustic signal, wherein said proximate location that receives said lead acoustic signal is indicative of where along said wellbore said fluid ingress is occurring.

17. The method of claim 16, wherein said proximate locations are regularly spaced along said wellbore.

18. A method for detecting fluid ingress in a wellbore and obtaining an indication of where along said wellbore said fluid ingress is occurring, the method comprising:

(a) placing acoustic sensing means along at least a first portion of said wellbore, said acoustic sensing means adapted to sense individual acoustic signals from a plurality of known locations along said wellbore and positioned to sense individual acoustic signals from a plurality of known first proximate locations along said wellbore when placed along at least said first portion of said wellbore;

(b) when said acoustic sensing means is placed along at least said first portion of said wellbore, receiving a first pair of acoustic signals from said acoustic sensing means over a first selected time interval, each of said first pair of acoustic signals having associated therewith one of said first proximate locations;

(c) moving said acoustic sensing means such that said acoustic sensing means is placed along at least a second portion of said wellbore to sense individual acoustic signals from a plurality of known second proximate locations along said wellbore;

(d) when said acoustic sensing means is placed along at least said second portion of said wellbore, receiving a second pair of acoustic signals from said acoustic sensing means over a second selected time interval, each of said second pair of acoustic signals having associated therewith one of said second proximate locations;

(e) identifying at least a first common acoustic component in said first pair of acoustic signals by analyzing each of said first pair of acoustic signals received over said first selected time interval;

(f) identifying, as a first lead acoustic signal, one of said first pair of acoustic signals that possesses said first common acoustic component, wherein said first common acoustic component is at an earlier point in time compared to said first common acoustic component in the other of said first pair of acoustic signals;

(g) identifying at least a second common acoustic component in said second pair of acoustic signals by analyzing each of said second pair of acoustic signals received over said second selected time interval, wherein a first time delay between said first common acoustic components in said first pair of acoustic signals and a second time delay between said second common acoustic components in said second pair of acoustic signals are uniform; and (h) identifying, as a second lead acoustic signal, one of said second pair of acoustic signals that possesses said second common acoustic component, wherein said second common acoustic component is at an earlier point in time compared to said second common acoustic component in the other of said second pair of acoustic signals, and wherein said fluid ingress is occurring at a location at or between said first and second proximate locations that receive said first and second lead acoustic signals, respectively.

19. The method of claim 18, wherein prior to identifying said first and second common acoustic components said received signals are first filtered via a bandpass filter adapted to pass only low-frequency acoustic signals in a frequency range of 100 to 2000 Hz.

20. The method of claim 18, further comprising the step of labeling said common acoustic component in each of said acoustic signals.

21. The method of claim 20, wherein said step of labeling said common acoustic component comprises creating an amplitude versus time representation of each acoustic signal, and color coding said common acoustic component in each of said acoustic signal.

22. The method of claim 18, further comprising the steps of:

(i) creating a visual representation, in amplitude versus time format, of each acoustic signal over said selected time interval;

(ii) color coding each identified common acoustic component of each acoustic signal with a similar color; and (iii) determining, from said graphic representation of said acoustic signals which particular acoustic signal are said lead acoustic signals and thereby determining said location in said wellbore having fluid ingress.

23. The method of claim 18, wherein said acoustic sensing means is a fibre optic cable.

24. The method of claim 23, wherein said steps of receiving said acoustic signals from said acoustic sensing means over said selected time intervals comprises the use of time division multiplexing techniques.

25. The method of claim 18, wherein said step of analyzing each of said received acoustic signals comprises conducting an analysis selected from the group of analysis techniques comprising (i) an analysis of such signal with regard to amplitude of such acoustic signal over said time interval; (ii) a frequency analysis; (iii) a power analysis examining power as a function of frequency; (iv) a fast Fourier transform; (v) a root-mean-square analysis of amplitude over time; (vi) a means/variance analysis; (vii) a spectral centroid analysis; and (viii) a filter analysis so as to select only certain frequencies for the acoustic signals to be analyzed; and a combination of any of the foregoing.

26. The method of claim 18, wherein after having conducted steps (a) to (d), said process is repeated placing said acoustic sensing means along another portion of said wellbore.

* * * * *